US005787666A

United States Patent [19]

Sherry

[11] Patent Number: 5,787,666

[45] Date of Patent: Aug. 4, 1998

[54] THIN MASONRY VENEER PANEL SYSTEM AND THE FABRICATION THEREOF

[76] Inventor: Edward B. Sherry, 375 N. Main St., Sharon, Mass. 02067

[21] Appl. No.: 362,774

[22] Filed: Dec. 23, 1994

[51] Int. Cl.[6] ..... E04C 2/06

[52] U.S. Cl. ..... 52/315; 52/391; 52/392; 52/511; 52/605

[58] Field of Search ..... 52/392, 315, 511, 52/605, 746.12, 747.11, 747.12, 391

[56] References Cited

U.S. PATENT DOCUMENTS

| | | | |
|---|---|---|---|
| 1,382,652 | 6/1921 | Kiefer | 52/592.1 X |
| 1,809,504 | 6/1931 | Carvel | 52/747.12 X |
| 2,122,696 | 7/1938 | Poston | 52/315 X |
| 2,537,466 | 1/1951 | Kiefer | 52/511 X |
| 3,331,175 | 7/1967 | Terrio | 52/315 |
| 3,344,570 | 10/1967 | Marson | 52/315 |
| 3,504,469 | 4/1970 | Painter | 52/315 |
| 3,874,140 | 4/1975 | Seehusen | 52/315 |
| 4,445,802 | 5/1984 | Loov | 404/40 |
| 5,069,014 | 12/1991 | Kubbutat | 52/511 X |

*Primary Examiner*—Christopher Kent
*Attorney, Agent, or Firm*—Charles Bickoff

[57] ABSTRACT

A system of light weight, high strength, thin masonry panels having one or more mateable seam hiding edges. The seam hiding edge may be serpentine or some other shape consistent with the masonry element chosen for the panel surface. The aforementioned thin masonry panels are used to construct patio or walkway surfaces as well as provide a decorative facing for walls, fireplaces, and the like. The thickness of the panels is limited to the range of 1 to 2 inches in order to assure a light weight for ease of construction. Each panel is a reinforced series of masonry elements such as stone or brick pavers bound together by a cement or mortar-like material. The claimed invention also includes an attachment plate for affixing the panels to other surfaces and structures.

12 Claims, 5 Drawing Sheets

THIN MASONRY VENEER PANEL SYSTEM AND THE FABRICATION THEREOF

BACKGROUND

1. Field of the Invention

The present invention pertains to a system of prefabricated thin masonry panels used to construct walkways, patios, walls, fireplace veneers, stairs, and the like. In particular the panels offer a unique way to construct durable, thin, masonry veneered structures using reinforced prefabricated panels. They incorporate a range of aesthetically pleasing stone-like or brick-like facing elements or the combination thereof with interlocking (complimentary) alignment edges and attachment and jointing features.

Veneers using the same or similar facing materials have historically been constructed using tedious on-site manual methods. In the case of walkways, shallow excavations are done, materials such as crushed stone, gravel, or stone dust are laid down, the stone or brick is placed, and mortar or other materials are used to fill the spaces between the masonry material. As can be appreciated this process is a labor intensive time consuming effort. Moreover, the long term result may be unsatisfactory as there is generally little strength to the walkway or resistance to shifting or settling as the structure has little integrity.

When building masonry stairs, the process is likewise time consuming as it involves setting up forms, or building up the structure with blocks and mortar. The present invention serves as the forms and risers for constructing the stairway while simultaneously providing a decorative veneer.

The panels may also be used to provide the external decorative veneer for fireplaces and masonry walls. The preformed panels may have fastening means included to facilitate the attachment and assembly of the structure.

2. Prior Art

U.S. Pat. Nos. 4,326,817, 4,445,802, and 4,544,305 teach the use of a variety of regular shaped prefabricated concrete blocks to form walkways and paths. These paths and walkways are shaped by arranging combinations of the various rectangular and crescent shaped blocks on the prepared ground. The end result is that these inventions essentially replace classical brick and stone with precast shaped masonry elements but do little to enhance the strength of the product, reduce its thickness, or reduce the on-site labor content. Moreover the use of materials is limited to the precast shapes. These inventions are similar but differ geometrically.

U.S. Pat. No. 4,956,949 teaches the use of a specific construction of Brick Veneered Panels utilizing a low strength plastic foam as the backing and thermal insulating board. This invention lacks structural strength, is non-load bearing, and is temperature limited thereby targeting its use to purely decorative applications needing insulating characteristics supplied by the foam.

The present invention addresses the above limitations in several ways. Panels are constructed having a decorative facing and wear surface, a reinforcing means, a binding means, interfacing surfaces, interlocking means, and where applicable mounting means. The decorative and wear resistant facing material may be chosen from but is not limited to a variety of materials such as natural stone, brick, concrete shapes, tile, or shapes fabricated from other natural or synthetic materials. The strength issue is addressed through the addition of an imbedded reinforcing means such as but not limited to reinforcing rods, welded wire screen, wire mesh, expanded metal, or synthetic materials such as fiberglass. The panel is formed by casting mortar, masonry cement, synthetic polymeric materials, or the like around the stonelike materials and having imbedded within the cast material the reinforcing and attachment means. A feature of the panels is that opposing edges have mating faces which coalign with adjacent panels and such coaligned edges have a rabbited edge for the application of jointing materials. Because of the nature of the interlocking edge shape, the mateable edges between the adjoining panels are seem hiding. Where applicable, attachment means are cast into the binding material as part of the panel design or affixed to imbedded inserts as required.

The invention also includes a method for fabricating said panels in either a face down manner to facilitate the achievement of a relatively flat outer surface, or face up to obtain a flat back surface. A flat outer surface is desirable when the veneer is to be walked upon, while a flat back surface is desirable where installation so requires and added irregularity of depth enhances the visual appearance.

THE INVENTION OBJECTS

Several objects and advantages of the present invention include:

a. providing a fabricated panel having a wear resistant and decorative face.

b. providing a panel with suitable load bearing strength to be useful in the construction of walkways, patios, staircases, and the like.

c. providing a decorative panel with suitable structural and heat resisting characteristics and having appropriate attachment means suitable for use in the construction of fireplace facings, mantles, and veneers.

d. providing a panel shaped in the form of a riser to be used in combination with preformed stair facings and having suitable attachment means to assemble a masonry stair case form to construct same.

e. providing a decorative panel with suitable structural integrity and having appropriate attachment means suitable for use in the construction of wall facings and veneers.

A further object is to provide a set of preformed panels having straight and arced sections to allow the construction of straight and curved pathways limited only by the arrangement of the panels.

Another object is to provide a set of preformed panels having interlocking edges on all four sides to allow the construction of large floor or wall areas when laid or installed on the appropriately prepared surface.

Another object is to provide a method of construction of panels wherein the outer surface is relatively flat.

A further object is to provide a method of construction wherein the back surface is relatively flat.

An additional object is to provide a form which has raised sections in between regularly shaped stonelike or bricklike facing material to create a depressed joint on the finished face.

Additional objects will be obvious to those skilled in the art from the drawings and detailed description which follows.

DRAWINGS

SUMMARY

The invention herein described is for a Thin Walled Veneered Masonry Panel used to construct walkways, patios, stairways, wall veneers, fireplace facings, floors, and the like. The unique construction allows the pre-fabrication of thin, light, high strength panels which are quickly assembled on site to form an integrated structure. The panels are reinforced and have integral anchor points to facilitate mounting and attachment as required by the application.

The panels are provided in a variety of shapes suitable to the application. In the case of walkways, straight and curved sections are provided such that straight, serpentine, or circular walks may be constructed. Straight, 30 degree, and 45 degree sections are standardly desirable. It will be recognized by those skilled in the art that other arcuate sections are possible.

The edge shape of the panels are such that they mate and coalign with adjacent panels. The mating edges are rabitted for the purpose of retaining the jointing compound and results in an invisible joint. This invisible joint is formed by the mateable seam hiding edges of adjacent panels.

Panels may be fabricated either face up or face down. The face up method is used when an irregular surface having high visual definition is desired or when a flat back is needed for the particular application. The face down method is used when it is desirable to have a relatively flat outer surface in applications where the panel will be walked upon.

DETAILED DESCRIPTION OF THE BEST MODE

The following description illustrates the invention by way of example, not by way of limitation of the principles of the invention. The description will clearly enable one skilled in the art to make and use the invention. It describes several embodiments, variations, and adaptations including what I believe to be the best mode.

Figure 10:
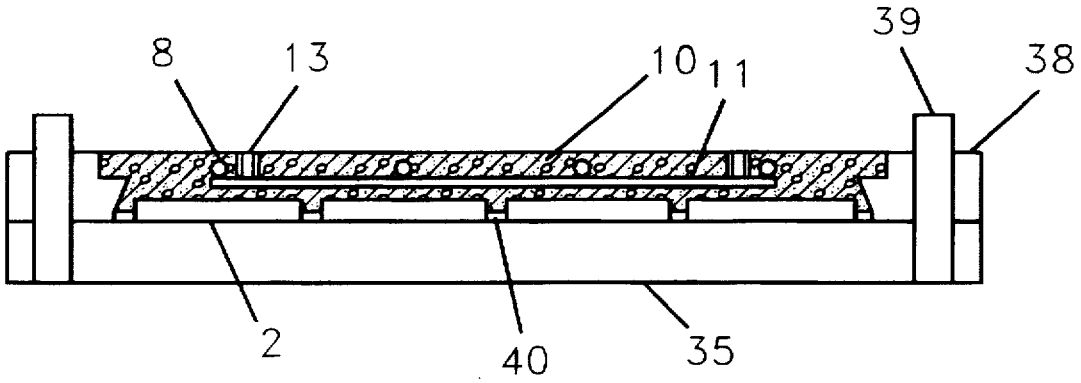
FIG. 10 is a sectional view showing construction of panel upside down.

The preferred embodiment of the Thin Masonry Veneer Panel System for Construction of Walks, Stairs, Walls, Fireplaces, and the Like and the Fabrication Thereof is illustrated in FIGS. 1 through 7. The method for fabricating the panels in a face down manner is illustrated in FIG. 10.

Figure 1:
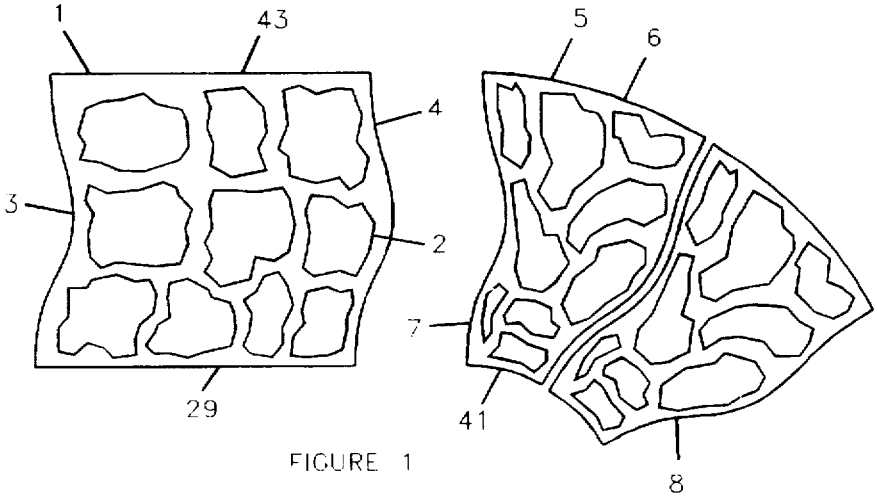
FIG. 1 is a plan view of a typical walkway panels

FIG. 1 shows a typical set of walkway panels having a straight section generally indicated by numeral 1 and curved sections generally indicated by numeral 6. The straight walkway panel is characterized by having two opposed straight sides 29 and 43, opposing serpentine edges 3 and 4 generally orthogonal to the straight edges 29 and 43, stonelike or brick-like masonry elements 2 used as a walking surface, and a concrete-like matrix to affix the stonelike or brick-like masonry elements into a finished panel. Curved sections are generally depicted as numeral 6 and have mating edges 7 and 8 which align with each other as shown by the two abutting arcuate sections. Said mating edges mate with the corresponding edges 3 and 4 of the straight section 1. Curved and straight sections are abutted in various combinations to form straight, curved, circular, and combined shaped pathways. The serpentine edge is preferably defined by opposing arcs having a 15 inch radius with centers spaced 24 inches apart parallel to a common chord. The arcs necessary to complete the serpentine are on the opposed side of the chord and the centers are midway between the centers on the opposite side. In this case, said displacement is 12 inches. The distance between said common chord and the apex of each arc is 1¼ inches. On a 24 inch by 48 inch panel these dimensions yield one cycle along the short side and two cycles along the long side. It will be recognized by those skilled in the art that other dimensions are possible as long as the number of cycles of the long side is double that of the short side or the number of cycles is the same if both sides are the same length. A saw tooth edge may likewise be constructed using the same rules.

Figure 9:
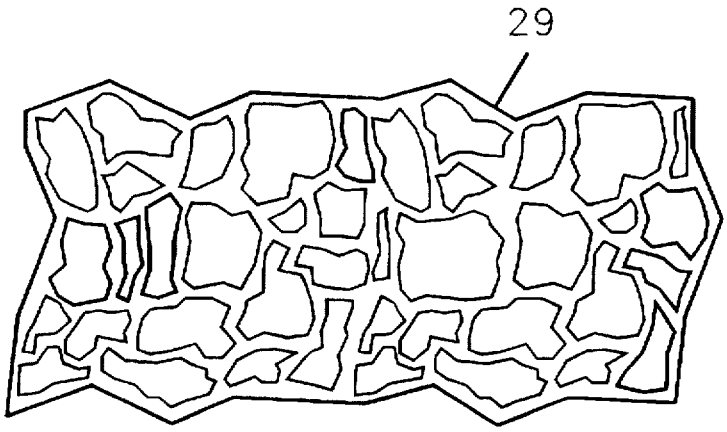
FIG. 9 is a plan view of a Blasted Rock Panel
Figure 8:
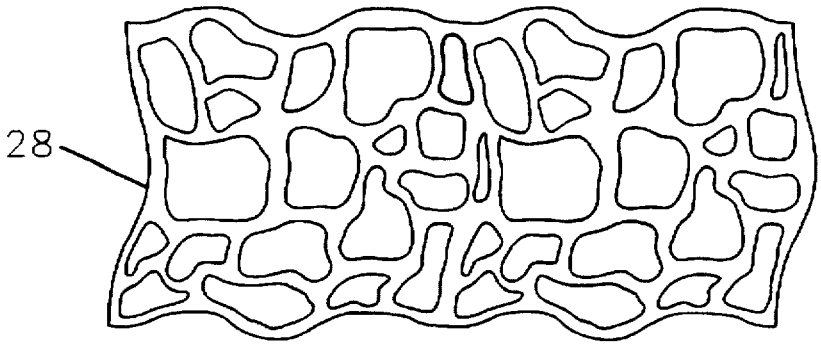
FIG. 8 is a plan view of a Field Stone Panel
Figure 7:
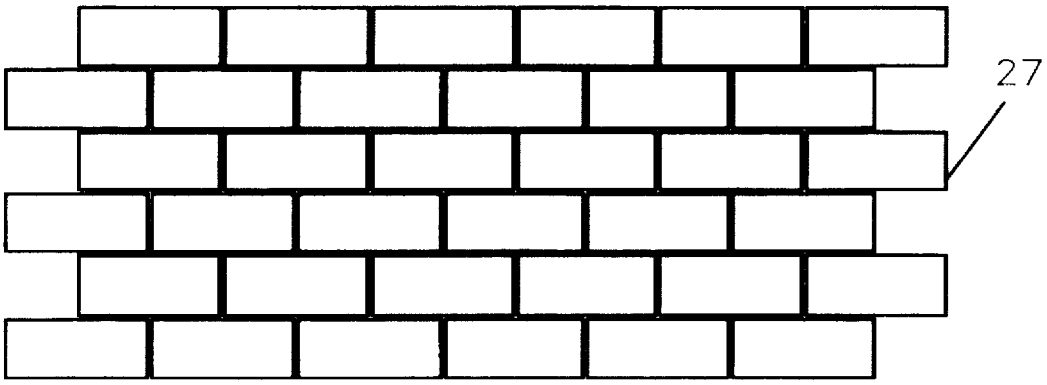
FIG. 7 is a plan view of a Brick Panel

The curved edge shape shown in FIG. 1 is used to hide the joint between mating panels when a proper concrete-like jointing compound is utilized to fill the spaces between mating panels. The serpentine edge is particularly suited for hiding the joints in fieldstone panels. FIGS. 7, 8, and 9 show panels made from Fieldstone, Brick Pavers, and Blasted Rock. The edge detail for these panels is shown as an appropriate method for hiding interpanel joints of panels made from these materials or analogs. FIG. 7 shows a Dentil Edge 27 suitable when using Brick-like materials such as Brick Pavers. The definition of a Dentil Edge is one formed by offsetting alternate bricks a fixed amount in a tooth-like fashion. This fixed amount is normally one-half the brick length, but other amounts are possible as long as the end result interlocks with the opposing edge of the mating panel. FIG. 8 shows a Serpentine edge 28 suitable for Fieldstone-like shaped materials and FIG. 9 shows a Sawtooth edge 29 suitable when using Blasted Rock-like shapes. It will be recognized by those skilled in the art that combinations of the above materials may be used in a singular panel. That is, a Fieldstone center with Brick edging by way of example. As such, combination edges of the above three types may be suitable in such configurations.

Figure 2:
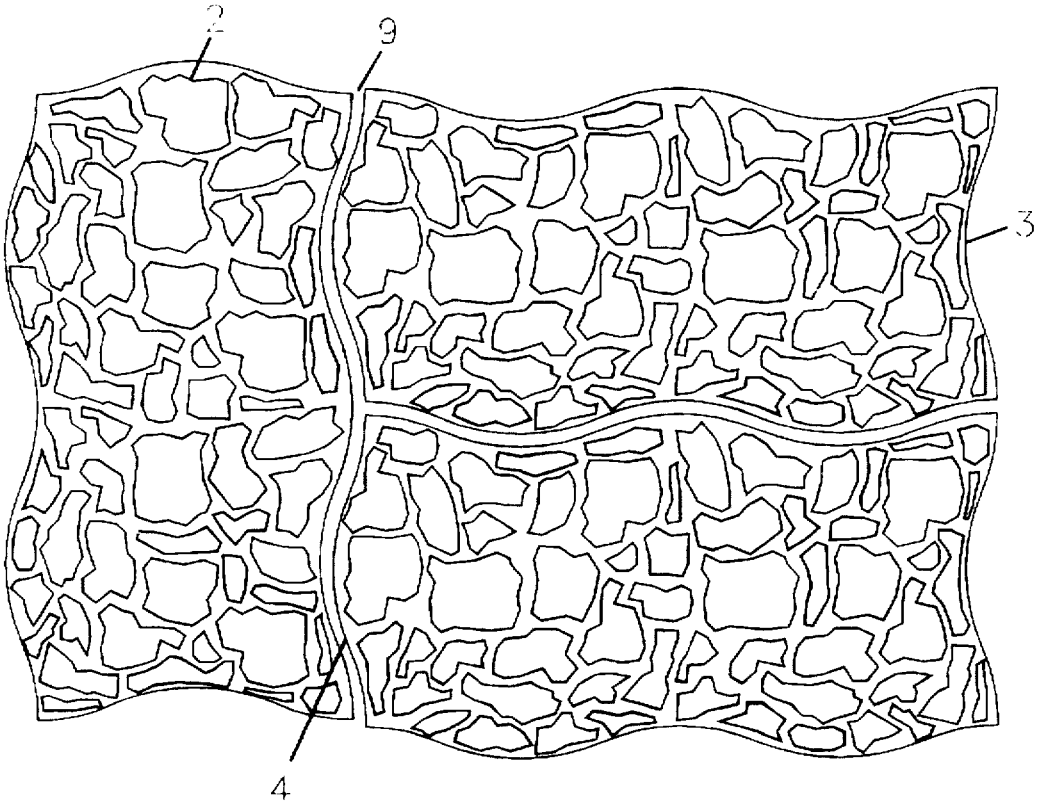
FIG. 2 is a plan view of a typical flooring panels

FIG. 2 shows a series of panels having mating edges such as 3 and 4 on all four edges. This configuration allows the panels to be assembled into walls, floor areas, and the like. The spaces between adjoining panels are filled and finished with an appropriate jointing compound, well known in the art, to hide the mating joints. FIG. 2 shows three panels arranged to mate their edges. The left-most panel is set vertically and the abutting panels are set horizontally. In the case of 2 foot by 4 foot panels, this allows the flexibility of assembling the array in 2 or 4 foot increments.

Figure 3:
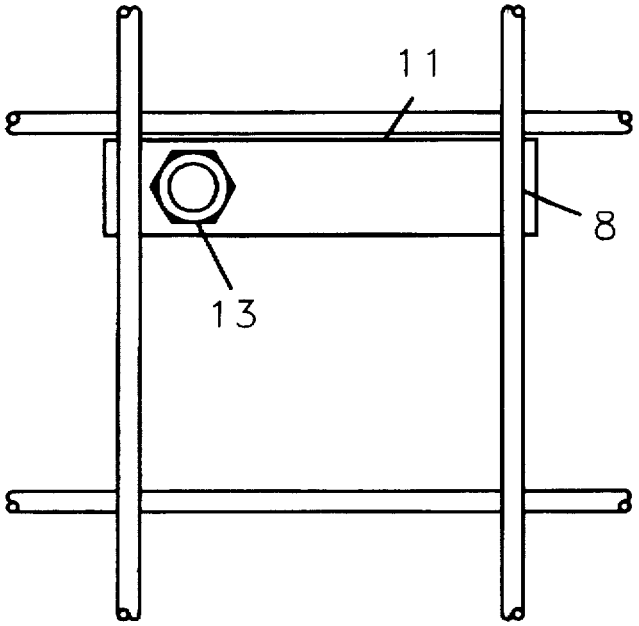
FIG. 3 shows an anchor attachment detail.

FIG. 3 illustrates the detail of the reinforcing screen and attachment detail. The welded wire reinforcing screen, typically 4×4–6×6 welded wire 8 is used to strengthen the panels. This wire screen is 4 inch square with 6 gauge wire in both the x and y directions. It will be recognized by those skilled in the state of the art that other similar material of different pitches and wire gauges could be used. It will also be recognized that the wire-like shapes could be replaced by other metallic and nonmetallic grids suitable for reinforcement and attachment of anchor points. A typical attachment points is formed using 1 inch wide by 4⅛ inch long by ⅛ inch thick strip of steel 11 and preferably welding a ½ inch threaded nut 13 to said steel strip adjacent to the juncture of the orthogonally welded wires. There is no hole in the steel behind the nut. This prevents threaded studs from pushing against the concrete and stone behind the plate, thereby preventing damage to the masonry through over-tightening said studs. The anchor plate is affixed to the welded wire toward the stone side thereby utilizing a drawbar effect when attaching panels and eliminating tensile stress upon the attachment to the wire. Typically the anchor means is welded to the wire reinforcing means. It will be recognized by those skilled in the art that other attachment means such as weld studs, pins, brackets and the like could be affixed to the welded anchor plate. It will also be recognized that the anchor plate could be mechanically affixed to the reinforcement means as well.

Figure 4:
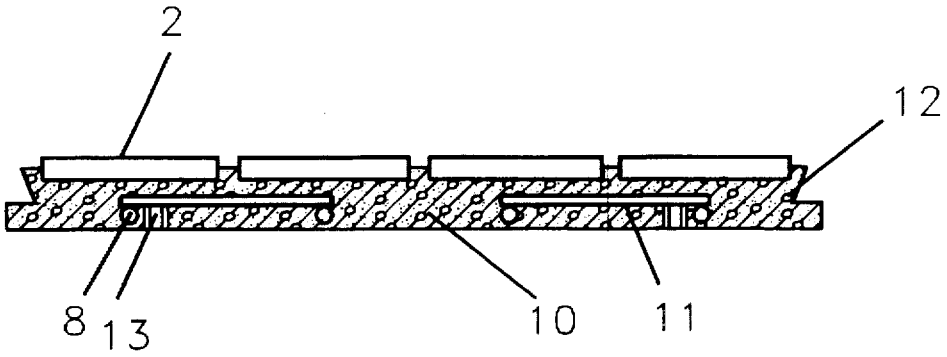
FIG. 4 is a cross section showing the construction and edge detail of a typical panel.

FIG. 4 shows a cross section of a typical panel. Said panel comprised of a series of stone-like or brick-like elements 2, a reinforcing screen as described above, and a concrete-like matrix 10. The interpanel edge detail formed in the cast concrete has a dovetail shape 12 to mechanically retain the jointing compound. The thread in the anchor nut is fastened by a suitable means prior to pouring the concrete as will be recognized by those skilled in the art.

Figure 5:
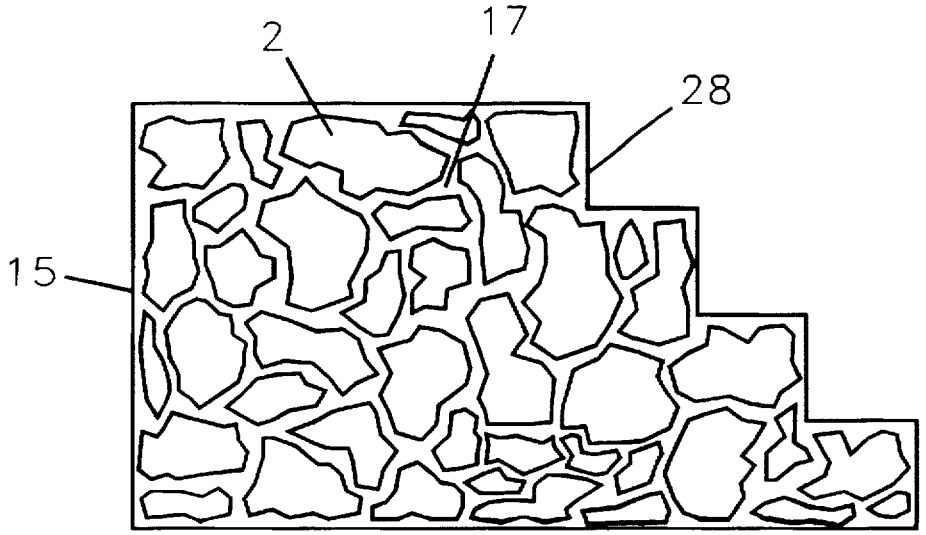
FIG. 5 is a plan view of a typical stair riser panel

FIG. 5 shows a staircase riser panel generally delineated as 15 and having risers 28. The panels are erected by threading threaded rod into the anchor points, spacing the panels the appropriate distance apart and welding the rods together midway between the panels. Prefabricated face plates are then attached to the stair facing and normal means are used to fill the erected form/veneer and treads and platform are then applied.

Figure 6:
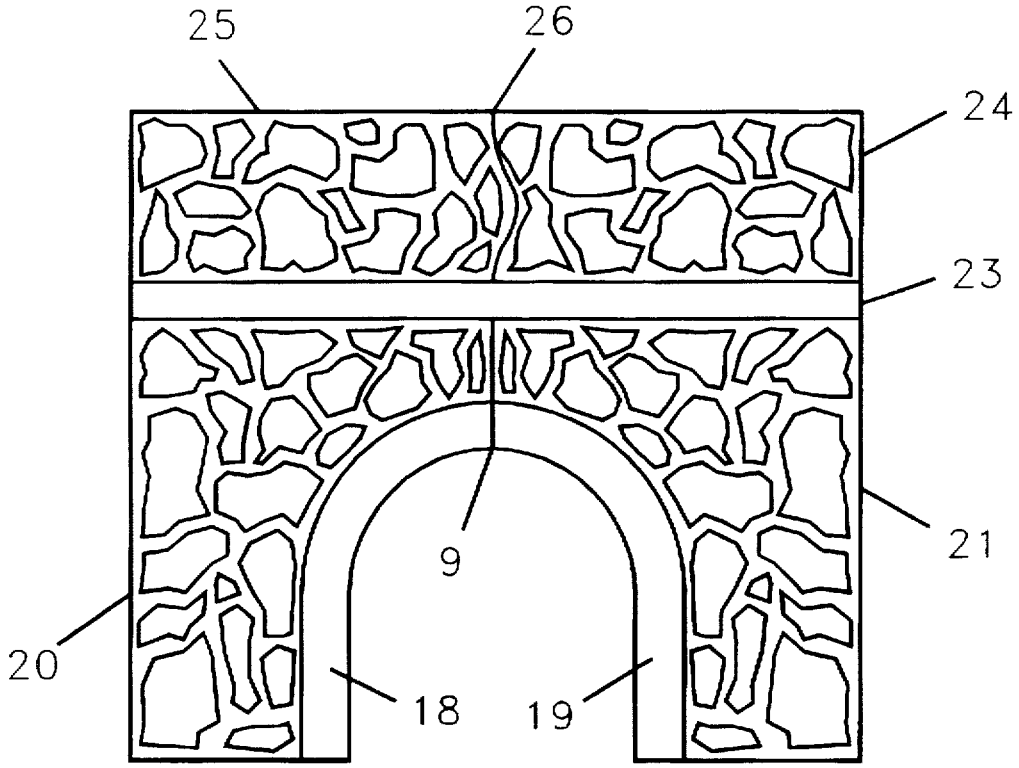
FIG. 6 is a plan view of a typical fireplace veneer panel

FIG. 6 shows a typical panel set for a fireplace facing. Panels 18 and 19 are typically 10 inches wide and fastened to the firebox using Firebox hangers. Panels 20 and 21 are then installed to finish the lower part of the fireplace. A mantel 23 is installed to cap the lower panels 20 and 21 and an optional set of panels may be installed above the mantel. The joints are filled with an appropriate concrete-like jointing compound 9 to finish installation.

FIG. 10 is a cross sectional view which illustrates the typical method of fabricating a panel. The form consists of a base board 35, edge formers 37 and 38 and alignment pins 39. The base board 35 serves as the bottom of the form and has holes for receiving the alignment pins 39. The edge formers are an appropriate shape to form straight, curved, and interfacing edges. These edges include those required for stair risers and also special shapes as used in fireplace mantel kits shown as FIG. 6. The edge formers have mating alignment pin holes which coalign with those in the base board 35. The edge formers have a dovetail detail in those formers used to shape interpanel edges.

The form is assembled and held together with the alignment pins 39. The stone-like facing material 2 is then placed face down in the assembled form and coated with a bonding agent such as "ANCHOR IT". The space 40 between the stones is then pointed with ⅛ inch to ¼ inch of a weak concrete mix, 1 part portland cement to 3 parts sand. Such a mix characteristically cures at a slower rate than. A thin layer of concrete grout is then placed over the stones and pointed. The reinforcing screen with attached anchors is next placed in the form. The screen is set such that the outside face of the anchor nuts is flush with the finished back surface. Anchor points are masked off and the remainder of the form is filled with a standard 2¼ part portland to 1 part sand concrete mix 10. The panels are allowed to air cure for 6 to 7 hours at which time the panel flipped over and the form base board is stripped. The weak concrete is still workable at this time and is pointed from the outside to yield an aesthetically pleasing appearance. The panels may continue their air cure or may be accelerated using a steam cure. Steam curing methods are well known in the art. This method yields panels ranging in thickness from 1 to 2 inches depending upon the facing material used. A typical 2 foot by 4 foot fieldstone panel is 1⅛ inches thick and weighs approximately 160 pounds. A similar result can be obtained when the stone-like or brick-like facing material is regularly shaped and numeral 40 is an integral filler attached to the base board. This option eliminates the pointing operation after partial cure.

In the use of regularly shaped brick pavers, a thinner panel can be attained by replacing the welded screen with reinforcing bar. The first reinforcing bar is bent to appropriately follow the inter brick spaces and is laid upon the slow setting concrete mixture. The remainder of the panel construction follows that previously described.

As will be obvious to persons skilled in the art, various modifications, adaptations, and variations of the specific disclosure can be made without departing from the teaching of the invention.

Having thus described this invention, what is claimed is:

1. A thin veneer masonry panel consisting of:

a plurality of masonry elements having a first surface forming an outer face;

a masonry binding means;

said masonry binding means fixedly forming said masonry elements into a panel array;

a reinforcing means spaced subjacent to a second surface of the masonry elements and embedded in the masonry binding means;

an attachment means fixedly attached to said reinforcing means;

said attachment means is a steel plate having a nut with a first surface fixedly attached to said steel plate proximate a corner;

said attachment means fixedly attached to said reinforcing means;

said reinforcing means positioned within said concrete so that a second surface of said nut welded to said steel plate is coplanar with a back surface of said thin veneer masonry panel;

said thin veneer masonry panel being a weight saving panel wherein a thickness of said thin veneer masonry panel lies within a range of 1.0 to 2.0 inches;

said thin veneer masonry panel having at least three shaped edges with at least one of said edges being a mateable seam hiding edge;

said thin veneer masonry panel being mateable with at least one adjacent thin veneer masonry panel; and said masonry elements being arranged in a shaped edge conforming pattern to create a seam hiding affect.

2. The thin veneer masonry panel according to claim 1 wherein said masonry binding means is concrete;

said reinforcing means is a welded wire steel screen and;

said attachment means fixedly attached to said welded wire steel screen with said nut proximate an intersection of a first and second wire of said welded wire steel screen.

3. The thin veneer masonry panel according to claim 1 wherein the mateable seam hiding edge has a jointing compound receiving rabbited shape; and said jointing compound receiving rabbited shape is a one-half dovetail with an apex proximate to said first surface forming an outer face of said masonry elements.

4. The thin veneer masonry panel according to claim 3 wherein said mateable seam hiding edge is a serpentine shaped edge.

5. The thin veneer masonry panel according to claim 1 wherein first and second shaped edges are opposing straight edges; and at least one angularly related edge being a mateable seam hiding edge.

6. The thin veneer masonry panel according to claim 5 wherein said first and second shaped edges are arcuate;

at least one of a third and fourth orthogonal shaped edge is a seam hiding and mateable shaped edge; and said first shaped edge lies on a first arcuate radius and said second shaped edge lies on a second arcuate radius within an angular range of 30 degrees to 45 degrees with reference to said first interfacing shaped edge.

7. The thin veneer masonry panel according to claim 1 wherein a set of thin veneer masonry panels form an outer decorative fireplace surface said decorative fireplace surface has at least one mating pair of first interfacing seam hiding shaped edges wherein said pair of first interfacing shaped edges mateably complete an outer decorative fireplace veneer;

a second interfacing shaped edge of each of said thin veneer masonry panels are orthogonal mantel engaging edges to said pair of first interfacing seam hiding shaped edges;

a third interfacing shaped edge of each of said thin veneer masonry panels are orthogonal to said mantel engaging edges;

a fourth interfacing shaped edge of each of said thin veneer masonry panels are orthogonal floor engaging straight edges to said third interfacing shaped edges; and a fifth pair of firebox interfacing shaped edges.

8. The thin masonry veneer panel according to claim 3 wherein said interfacing shaped edges have a triangular shaped cavity for receiving mortar with the widest portion of said triangular shaped cavity furthermost from the front surface of said thin masonry veneer panel.

9. The thin veneer masonry panel according to claim 1 wherein two opposed shaped edges are straight shaped edges and do not have a joint compound receiving rabbited shape; and at least one orthogonally opposed straight shaped edge is a triangular mortar receiving seam hiding edge.

10. The thin masonry veneer panel according to claim 3 wherein said masonry elements are a thin brick veneer and said interfacing shaped edges are a dentil shape;

said dentil shape being formed by offsetting one course laterally from a previous course, thereby forming an edge with alternately offset brick edges.

11. The thin veneer masonry panel according to claim 1 wherein two opposed shaped edges are straight shaped edges and do not have a joint compound receiving rabbited shape;

first and second interfacing shaped edges are a dentil shape; and said first and second interfacing shaped edges are mateable.

12. The thin veneer masonry panel according to claim 1 wherein said masonry binding means is concrete;

said reinforcing means is a steel reinforcing bar;

said attachment means is welded to said steel reinforcing bar with said nut proximate an intersection of a first and second bar of said steel reinforcing bar; and said first reinforcing bar is positioned within a space between regularly shaped masonry elements.

* * * * *